US011410517B2

(12) United States Patent
Tanaka

(10) Patent No.: US 11,410,517 B2
(45) Date of Patent: Aug. 9, 2022

(54) FIRE DETECTION SYSTEM AND FIRE DETECTION METHOD

(71) Applicant: NEC Corporation, Tokyo (JP)

(72) Inventor: Akihiro Tanaka, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 17/290,455

(22) PCT Filed: Nov. 12, 2018

(86) PCT No.: PCT/JP2018/041854
§ 371 (c)(1),
(2) Date: Apr. 30, 2021

(87) PCT Pub. No.: WO2020/100197
PCT Pub. Date: May 22, 2020

(65) Prior Publication Data

US 2021/0383666 A1 Dec. 9, 2021

(51) Int. Cl.
*G08B 17/103* (2006.01)
*G08B 17/06* (2006.01)

(52) U.S. Cl.
CPC ..... *G08B 17/103* (2013.01); *G08B 17/06* (2013.01)

(58) Field of Classification Search
CPC ..... G01N 53/61; G08B 17/103; G08B 17/06
See application file for complete search history.

(56) References Cited

U.S. PATENT DOCUMENTS 4,021,792 A * 5/1977 Ludt ..... G08B 17/103 340/630
10,976,254 B2 * 4/2021 Tanaka ..... G08B 17/117
2004/0063154 A1 * 4/2004 Booth ..... G08B 17/113 435/7.1
2009/0229250 A1 * 9/2009 Yamakage ..... G01N 21/532 356/438

(Continued)

FOREIGN PATENT DOCUMENTS

JP S6024695 A 2/1985
JP H04148494 A 5/1992

(Continued)

OTHER PUBLICATIONS

International Search Report of PCT Application No. PCT/JP2018/041854 dated Jan. 29, 2019.

(Continued)

*Primary Examiner* — Hoi C Lau

(57) ABSTRACT

A fire detection system includes a transmitter including a light source that sends an optical signal and a receiver including a detector that detects the optical signal sent from the light source through a predetermined light propagation section, a signal processing unit that calculates at least one of a first gas concentration, a first smoke concentration, and a first temperature in the light propagation section based on the optical signal, a sensor that acquires at least one of a second gas concentration, a second smoke concentration, and a second temperature in the surroundings, and a determiner that determines whether there is a fire by comparing at least one of the first gas concentration, the first smoke concentration, and the first temperature with at least one of the second gas concentration, the second smoke concentration, and the second temperature in the surroundings.

6 Claims, 7 Drawing Sheets

(56) References Cited

U.S. PATENT DOCUMENTS

| | | | | |
|---|---|---|---|---|
| 2011/0188039 | A1* | 8/2011 | Aoyama | G01N 15/06 356/338 |
| 2017/0169683 | A1* | 6/2017 | Ryder | G08B 29/188 |
| 2020/0191716 | A1* | 6/2020 | Tanaka | G01N 21/61 |

FOREIGN PATENT DOCUMENTS

| | | | |
|---|---|---|---|
| JP | H02405299 | A | 7/1992 |
| JP | 2005083876 | A | 3/2005 |

OTHER PUBLICATIONS

M. Sasaki et al., "Technology and Procurement of Deep Underground Tunnels", 21st Japan-Korea Construction Technology Seminar, 2010, pp. 1-6.

T. Iseki, "Trace Gas Detection Technology Using Near Infrared Semiconductor Laser", Journal of the Japan Society of Mechanical Engineers, vol. 107, No. 1022, 2004, pp. 51.

H. Satio et al.,"Measurement of Atmospheric Carbon Dioxide by Applying Differential Absorption Spectroscopy in the Near Infrared Region", 31st Laser Sensing Symposium, D-3, 2013.

Yonggang Chen et al.,"Development of a Fire Detection System Using FT-IR Spectroscopy and Artificial Neural Networks", Fire Safety Science—Proceedings of Sixth International Symposium, pp. 791-802.

R. Mitchell Spearrin, "Mid-Infrared Laser Absorption Spectroscopy for Carbon Oxides in Harsh Environments", Ph. D. thesis, Sep. 2014, pp. 1-100.

Yonggang Chen et al., "Development of a Fire Detection System Using FT-IR Spectroscopy and Artificial Neutral Networks," Fire Safety Science—Proceedings of Sixth International Symposium, Jan. 2000, pp. 791-802 (12 pages).

* cited by examiner

FIRE DETECTION SYSTEM AND FIRE DETECTION METHOD

TECHNICAL FIELD

This application is a National Stage Entry of PCT/JP2018/041854 filed on Nov. 12, 2018, the contents of all of which are incorporated herein by reference, in their entirety.

The present disclosure relates to a fire detection system and a fire detection method of determining a fire status by propagating an optical signal in a long distance light propagation section.

BACKGROUND ART

Recently, urbanization has advanced in many countries around the world, and as many land spaces in urban areas are used for this urbanization, it has become difficult to ensure that there is enough land for new infrastructure development. In order to use urban spaces effectively, efforts are being made to construct underground facilities that do not necessarily have to be located on the ground.

For example, water supply and sewerage, gas, electricity, storage, communication infrastructure, and transportation are typical facilities that do not necessarily have to be located on the ground. In particular, the use of underground spaces is being actively promoted in view of the problem of worsening traffic congestion in urban areas. In addition, the ratio of tunnel structures to the total length of motorways in urban areas has been increasing. In 2010, less than 10% of the sections of Metropolitan Expressway that were in service had tunnel structures, while 70% of sections of Metropolitan Expressway that were under construction had tunnel structures (see Non Patent Literature 1).

In the tunnels of the motorways, which have been constructed frequently recently, it is necessary in the event of a fire to quickly and accurately detect the fire and then issue an alert and provide evacuation guidance equipment for safe evacuation of users from the tunnels. It has also been reported that about 70% of vehicle fires in Japan are caused by vehicle failures. In the case of a vehicle failure, no fire occurs for a period of time after the vehicle has stopped. For this reason, even though road operators recognize a situation that the vehicle has stopped by means of monitoring cameras (CCTV), etc., they cannot issue a fire alarm until the fire becomes actually visible, and there is a risk that the damage will expand due to a delay in an initial action being taken. Furthermore, in tunnels in Japan, fire alarms that detect infrared radiation from flames are mainly installed. This fire detector can detect infrared radiation from flames only after a fire occurs, so delays in initial response are unavoidable. In foreign countries, for example in Europe, temperature and smoke detectors have been introduced, but both of these detectors have advantages and disadvantages, such as slow reaction and difficulty in separating the temperature rise and smoke caused by a fire from those caused by the influences of dusts, etc. Since there are no detectors that can fully address various fire occurrence scenarios, it is important to address a wide range of fire occurrence scenarios by combining multiple detection parameters.

Under such circumstances, Patent Literature 1 discloses a method of dealing with a wider range of fire occurrence scenarios by utilizing an optical gas detection method of measuring the concentration of a target gas and the concentration of smoke in the surrounding atmosphere by propagating an optical signal for measurement into the atmosphere.

FIG. 7 shows a conceptual diagram of a fire detection system. In a transmitter (71), a condenser (713) converts an optical signal output from a light source (711) into a quasi-parallel beam and sends the quasi-parallel beam to a receiver (72). At the receiver (72), a condenser (721) condenses the received optical signal and a detector (723) converts the optical signal into an electric signal. The signal processing unit (725) performs predetermined signal processing on the electric signal to calculate an average concentration of a gas to be measured and an average smoke concentration present between the transmitter (71) and the receiver (72).

By this method, smoke generated by a fire and a gas (carbon monoxide, etc.) which may adversely affect the human body are simultaneously measured, and a fire alarm is issued when the thresholds of both this smoke and this gas are exceeded, thereby improving the reliability in detecting a fire. This method has another feature that just one detection system can monitor a wide range with the configuration in which the optical signal is propagated in the atmosphere.

Commonly, a fire detection system employs a method of detecting a gas while modulating a wavelength using a narrow wavelength band light source which outputs a wavelength around an absorption wavelength by utilizing a property of gas molecules absorbing light of a specific wavelength, and a method of calculating a gas concentration from a known spectral intensity using a light source of a wide wavelength band which widely covers the absorption wavelength.

Examples of the former method include Wavelength Modulation Spectroscopy (WMS) disclosed in Non Patent Literature 2, and examples of the latter method include Differential Optical Absorption Spectroscopy (DOAS) disclosed in Non Patent Literature 3.

CITATION LIST

Patent Literature

Patent Literature 1: Japanese Unexamined Patent Application Publication No. 2005-83876

Non Patent Literature

Non Patent Literature 1: M. Sasaki et al., "Technology and Procurement Of Deep Underground Tunnels", 21st Japan-Korea Construction Technology Seminar (2010)

Non Patent Literature 2: T. Iseki, "Trace Gas Detection Technology Using Near Infrared Semiconductor Laser", Journal of the Japan Society of Mechanical Engineers, Vol. 107, No. 1022, p. 51 (2004)

Non Patent Literature 3: H. Saito et al., "Measurement of Atmospheric Carbon Dioxide by Applying Differential Absorption Spectroscopy in the Near Infrared Region", 31st Laser Sensing Symposium, D-3 (2013)

Non Patent Literature 4: Yonggang Chen, et al., "Development of a Fire Detection System Using FT-IR Spectroscopy and Artificial Neural Networks," FIRE SAFETY SCIENCE-Proceedings of Sixth International Symposium, pp. 791-802

Non Patent Literature 5: R. Mitchell Spearrin, "Mid-Infrared Laser Absorption Spectroscopy For Carbon Oxides in Harsh Environments," Ph. D. thesis, September 2014

SUMMARY OF INVENTION

Technical Problem

However, the fire detection method of Patent Literature 1 has the following problems. The problem is that it is difficult to identify a fire under conditions such as road tunnel environments in which environmental changes at normal times are large. When the gas concentration or smoke concentration in a long distance light propagation section is measured by propagating an optical signal as in Patent Literature 1, the measured gas concentration or smoke concentration is an average value of the measurement section. For this reason, even if the gas concentration or smoke concentration is locally high due to a fire, the average value of the light propagation section cannot be very high, and the locally high gas concentration or smoke concentration becomes indistinguishable in the environment where the environmental changes are originally large.

An object of the present disclosure is to provide a fire detection system and a fire detection method capable of improving the accuracy of determining whether there is a fire under a condition where there is a large environmental change.

Solution to Problem

A first example aspect of the present invention to achieve the above object is a fire detection system including:

a transmitter including a light source configured to send an optical signal; and a receiver including:

a detector configured to detect the optical signal sent from the light source through a predetermined light propagation section;

a signal processing unit configured to calculate at least one of a first gas concentration, a first smoke concentration, and a first temperature in the light propagation section based on the optical signal detected by the detector;

a sensor configured to acquire at least one of a second gas concentration, a second smoke concentration, and a second temperature in the surroundings; and a determiner configured to determine whether or not there is a fire by comparing at least one of the first gas concentration, the first smoke concentration, and the first temperature calculated by the signal processing unit with at least one of the second gas concentration, the second smoke concentration, and the second temperature in the surroundings acquired by the sensor.

In this example aspect, the transmitter and the receiver may be integrated as a transceiver, the fire detection system may further include a first reflection unit disposed at a predetermined distance from the transceiver, the predetermined light propagation section may be formed between the transceiver and the first reflection unit, and the optical signal sent from the light source of the transceiver may reciprocate in the predetermined light propagation section between the transceiver and the first reflection unit.

In this example aspect, the sensor may include at least one of a gas sensor configured to measure the second gas concentration around the receiver, a smoke detector configured to measure the second smoke concentration around the receiver, and a temperature sensor configured to measure the second temperature around the receiver.

In this example aspect, the signal processing unit and the sensor may be integrated as a hybrid processing unit, and the transceiver may further include a second reflection unit configured to reflect the optical signal sent from the light source and an optical switch configured to switch between a direction of the first reflection unit and a direction of the second reflection unit and then emit the optical signal sent from the light source, and the hybrid processing unit may be configured to calculate at least one of the first gas concentration, the first smoke concentration, and the first temperature in the light propagation section based on the optical signal reflected from the first reflection unit and detected by the detector, and at least one of the second gas concentration, the second smoke concentration, and the second temperature in the surroundings based on the optical signal reflected from the second reflection unit and detected by the detector.

In this example aspect, the determiner may be configured to calculate a difference between at least one of the first gas concentration, the first smoke concentration, and the first temperature in the predetermined light propagation section of the optical signal calculated by the signal processing unit and at least one of the second gas concentration, the second smoke concentration, and the second temperature in the surroundings acquired by the sensor, respectively, and determine that the fire has occurred when each difference is greater than a threshold.

In this example aspect, the determiner may be configured to calculate an amount of change in the difference per unit and determine that the fire has occurred when the calculated amount of change is greater than a threshold.

Another example aspect of the present disclosure to achieve the above object may be a fire detection method including:

sending an optical signal from a light source;

detecting the optical signal sent from the light source through a predetermined light propagation section;

calculating at least one of a first gas concentration, a first smoke concentration, and a first temperature in the light propagation section based on the detected optical signal;

acquiring at least one of a second gas concentration, a second smoke concentration, and a second temperature in the surroundings; and determining whether or not there is a fire by comparing at least one of the calculated first gas concentration, the calculated first smoke concentration, and the calculated first temperature with at least one of the acquired second gas concentration, the acquired second smoke concentration, and the acquired second temperature in the surroundings.

Advantageous Effects of Invention

According to the present disclosure, it is possible to provide a fire detection system and a fire detection method capable of improving the accuracy of determining whether there is a fire under a condition where there is a large environmental change.

DESCRIPTION OF EMBODIMENTS

First Example Embodiment

A first example embodiment of the present disclosure will be described with reference to FIGS. 1, 2, and 3.

Configuration of the First Example Embodiment

Figure 1:
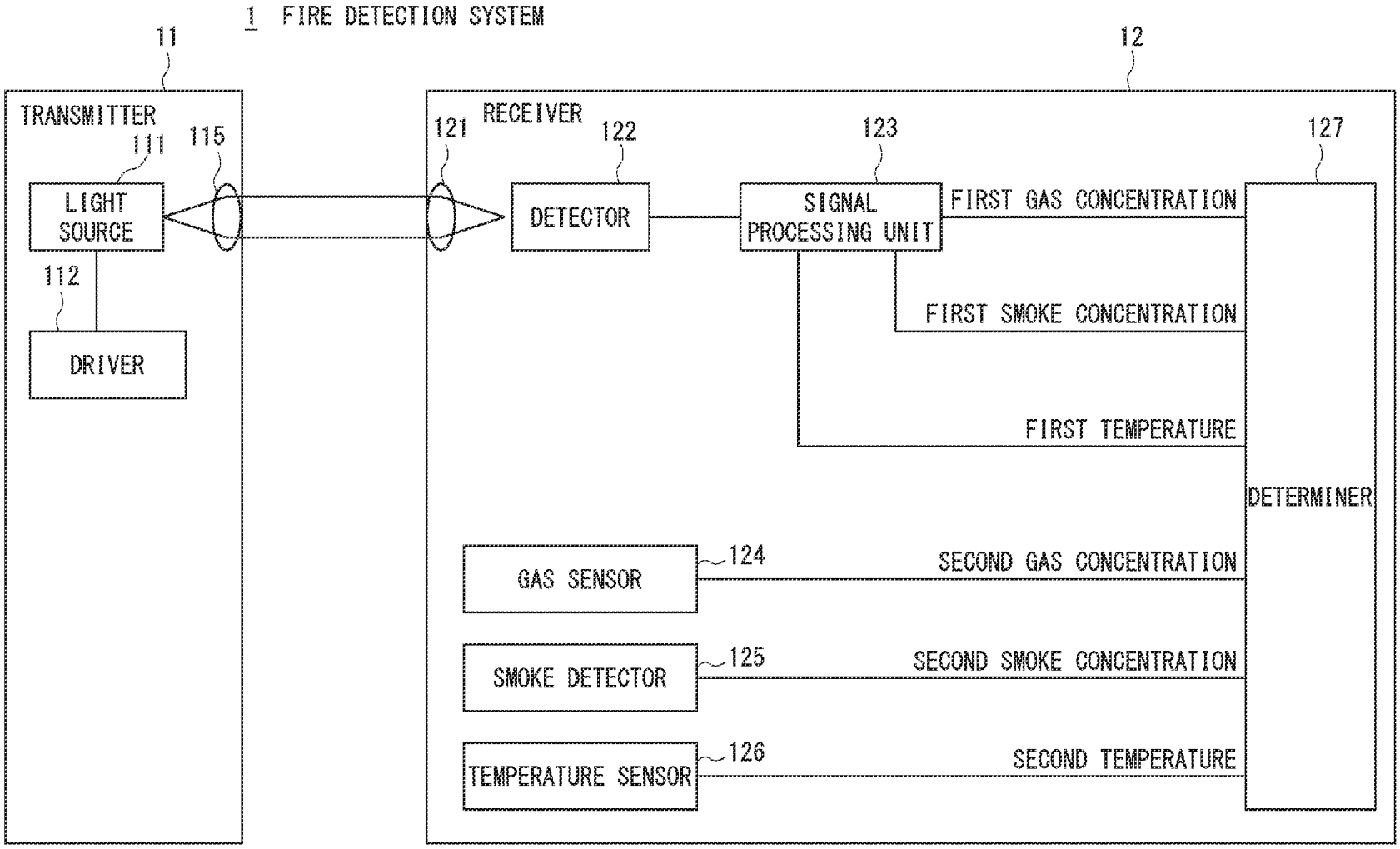
FIG. 1 is a block diagram showing a configuration of a fire detection system according to a first example embodiment of the present disclosure.
Figure 2:
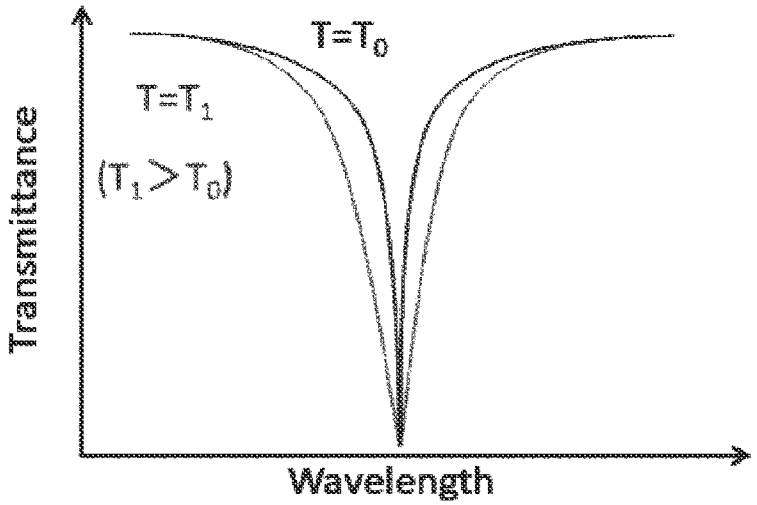
FIG. 2 is a schematic diagram showing a change in the shape of an absorption spectrum with ambient temperature.

FIG. 1 is a block diagram showing a configuration of a fire detection system according to a first example embodiment of the present disclosure. A fire detection system (1) according to the first example embodiment of the present disclosure includes a transmitter (11) and a receiver (12). A predetermined light propagation section is formed between the transmitter (11) and the receiver (12). The predetermined light propagation section is a long distance light propagation section.

The transmitter (11) and the receiver (12) have a hardware configuration with a microcomputer as a main component including, for example, a CPU (Central Processing Unit) for performing arithmetic processing and the like, a memory composed of a ROM (Read Only Memory) and a RAM (Random Access Memory) which store arithmetic programs and the like to be executed by the CPU, and an interface unit (I/F) for inputting and outputting signals to and from the outside. The CPU, the memory, and the interface unit are connected to each other via a data bus or the like.

The fire detection system (1) propagates an optical signal between the transmitter (11) and the receiver (12), and measures a first gas concentration, a first smoke concentration, and a first temperature in the space of the light propagation section. The transmitter (11) includes a light source (111), a driver (112), and a condenser (115). The receiver (12) includes a condenser (121), a detector (122), a signal processing unit (123), a gas sensor (124), a smoke detector (125), a temperature sensor (126), and a determiner (127).

Operation of the First Example Embodiment

The driver (112) controls a driving current and a temperature of the light source (111). Thus, the light source (111) outputs the optical signal having a wavelength $\lambda_1$ μm. The condenser (115) converts the optical signal output from the light source 111 into a quasi-parallel beam. The quasi-parallel beam propagated in the atmosphere is received by the receiver (12). The optical signal is condensed by the condenser (121) in the receiver (12) and is photoelectrically converted by the detector (122). The signal processing unit (123) processes the converted electric signal to calculate an average value of a carbon monoxide (CO) concentration (a first gas concentration) between the transmitter (11) and the receiver (12).

The signal processing unit (123) calculates the average value (the first smoke concentration) $C_s$ of the smoke concentration from a transmittance of the optical signal in addition to each of the first gas concentrations based on the following Formula:

$$I_s = I_o \times e^{-C_s D} \qquad \text{Formula (1)}$$

In this formula, $I_O$ is optical signal intensity projected from the transmitter (11), $I_S$ is intensity of light received by the receiver (12), and D is a distance between the transmitter (11) and the receiver (12).

The signal processing unit (123) also calculates an average space temperature (a first temperature) between the transmitter (11) and the receiver (12). A shape of an absorption spectrum of gas molecules used for measuring the gas concentration by WMS (Wavelength Modulation Spectroscopy) or DOAS (Differential Optical Absorption Spectroscopy) varies depending on the environmental temperature, the atmospheric pressure, and the interaction with other gas molecules. In particular, a change in a spectral width along with the change in the environmental temperature is noticable. The higher the temperature of the gas, the larger the velocity distribution of the gas molecules, and the wider the absorption spectrum becomes because of the Doppler broadening, as shown in FIG. 2. The signal processing unit (123) detects the spread of the spectral width to thereby calculate the average space temperature between the transmitter (11) and the receiver (12).

The gas sensor (124) measures a second gas (CO) concentration around the receiver (12). The smoke detector (125) measures a second smoke concentration around the receiver (12). The temperature sensor (126) measures a second temperature around the receiver (12).

Figure 3:
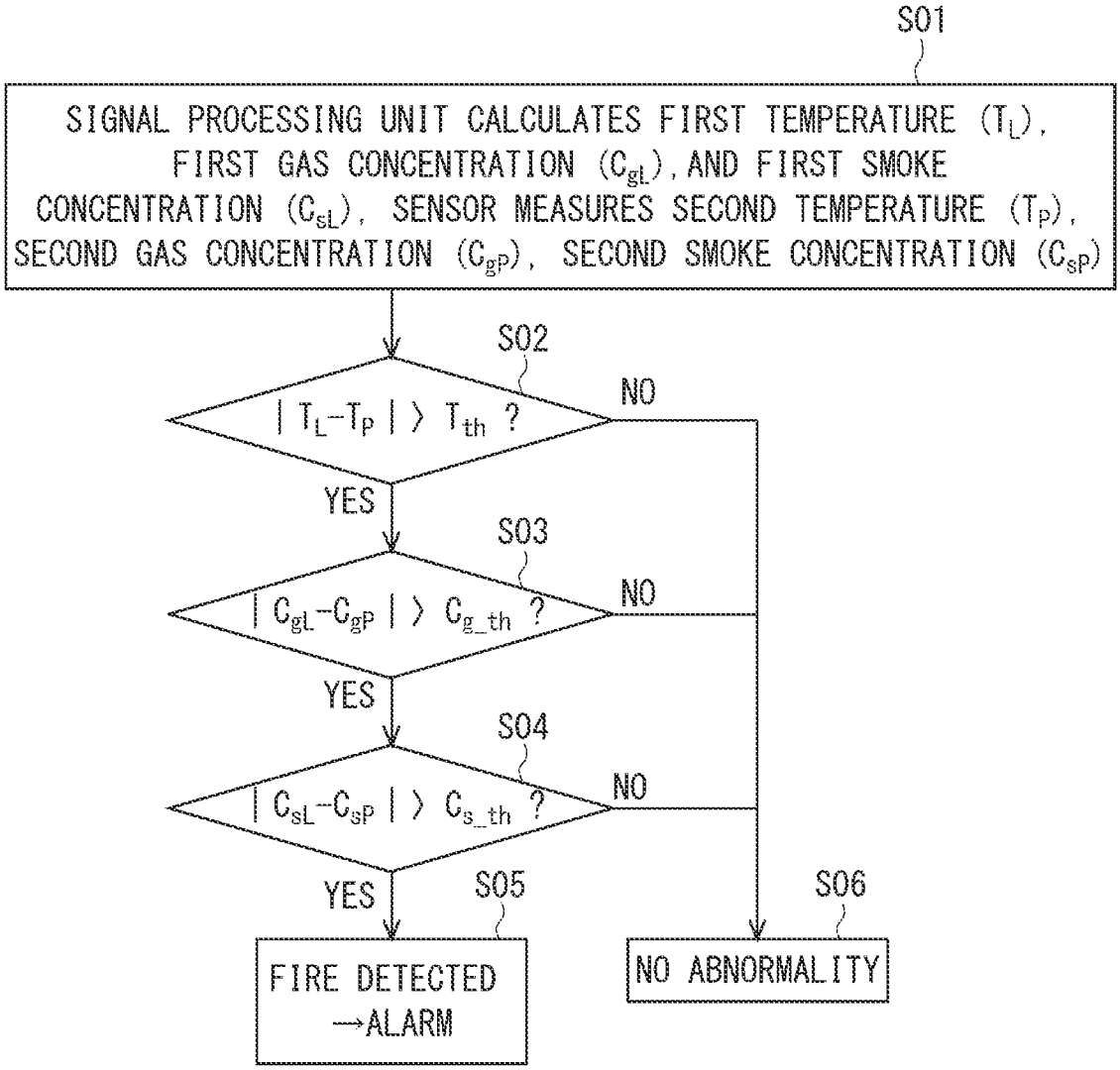
FIG. 3 is a flowchart showing a method of controlling the fire detection system according to the first example embodiment of the present disclosure.

The determiner (127) determines a fire state using the above measurement results of the first and second gas concentrations, the first and second smoke concentrations, and the first and second temperatures as parameters based on the flowchart shown in FIG. 3. First, the light source (111) sends the optical signal. The detector (122) receives the optical signal. The signal processing unit (123) calculates a first gas (122) concentration $C_{gL}$ based on an electric signal from the detector (CO). The signal processing unit (123) calculates a first smoke concentration $C_{sL}$ based on a transmittance of the optical signal. The signal processing unit (123) calculates a first temperature $T_L$ based on the spread of the spectral width.

The gas sensor (124) measures a local second gas (CO) concentration $C_{gP}$ around the receiver (12). The smoke detector (125) measures a local second smoke concentration $C_{sP}$ around the receiver (12). The temperature sensor (126) measures a local second temperature $T_P$ around the receiver (12) (Step S01). In this manner, the local second gas concentration, the local second smoke concentration, and the local second temperature around the receiver (12), which are environmental reference values, can be measured.

Next, the determiner (127) calculates a difference between $T_L$ and $T_P$, and determines whether the calculated difference is greater than a predetermined threshold $T_{th}$ (Step S02). If the determiner (127) determines that the difference is greater than the threshold $T_{th}$ (YES in S02), it calculates the difference between $C_{gL}$ and $C_{gP}$ and determines whether the calculated difference is greater than a predetermined threshold $C_{g_th}$ (e.g., 0.4 [l/m]) (Step S03).

If the determiner (127) determines that the calculated difference is greater than the threshold $C_{g_th}$ (YES in S03), it calculates the difference between $C_{sL}$ and $C_{sP}$ and determines whether the calculated difference is greater than a predetermined threshold $C_{s_th}$ (For example, 0.4 [l/m]) (Step S04).

When the determiner (127) determines that the calculated difference is greater than the threshold $C_{s_th}$ (YES in S04), it determines that a fire has occurred and outputs an alarm signal (Step S05). For example, an alarm (not shown) outputs an alarm sound in response to the alarm signal from the determiner (127). When the determiner (127) determines that the difference is smaller than the threshold in any of the Steps of S02, S03, and S04, it determines that there is no abnormality (Step S06). The influence of the environmental change can be canceled by calculating the differences between the measured environmental reference values of the second gas concentration $C_{gP}$, the second smoke concentration $C_{sP}$, and the second temperature $T_P$ and the first gas concentration $C_{gL}$, the first smoke concentration $C_{sL}$, and the first temperature $T_L$ calculated by the signal processing unit, respectively (123).

Effect of the First Example Embodiment

According to the first example embodiment, the following effects can be achieved.

A first effect is that a fire can be accurately detected when a environmental change occurs while, for example, vehicles travel under a condition where there can be a large environmental change such as in a road tunnel. A reason for this is that, in the related art, a determination of whether there is a fire is made based only on the gas concentration and smoke concentration in the long distance light propagation section. For this reason, when the environmental change is large, erroneous identification is often caused. On the other hand, in the first example embodiment, as described above, the local second gas concentration, the local second smoke concentration, and the local second temperature around the receiver (12) are incorporated into the flow of determining whether there is a fire as environmental reference values, so that the influence of the environmental change can be canceled.

The first example embodiment is not limited to the above configuration. For example, in the first example embodiment, the light source (111) is configured as a laser light source and instead the light source (111) may be configured as a broadband light source such as an LED (Light Emitting Diode) or an SLD (Super Luminescent Diode). The signal processing unit (123) may measure the gas concentration by DOAS accordingly.

An optical amplifier may be inserted into an output stage of the light source (111) or an input stage of the detector (122). By doing so, the signal-to-noise ratio of the received optical signal can be improved, and the accuracy of the measurement result can be improved.

The determiner (127) uses the carbon monoxide (CO) concentration as an indicator for determining a fire state but the indicator of determining the fire state is not limited to this. The determiner (127) may use, as the indicator for determining the fire state, a carbon dioxide ($CO_2$) concentration, a water vapor ($H_2O$) concentration, or a ratio of the CO concentration to the $CO_2$ concentration as described in Non Patent Literature 4, etc. The output wavelength $\lambda_1$ of the light source (111) may be set as the absorption wavelength of $CO_2$ or $H_2O$ accordingly. A plurality of kinds of gas concentrations may be measured using a plurality of light sources.

In the first example embodiment, CO is selected as the gas species to be measured, and 10 [ppm] is set as a gas concentration threshold, but the present disclosure is not limited thereto. Another value may be set as the threshold, or the determination may be made using another gas concentration. Further, although 0.4 [l/m] is set as a smoke concentration threshold, another value may be set as this threshold.

In the first example embodiment, the signal processing unit (123) measures the average space temperature in the predetermined light propagation section based on the spread of the spectral width of the absorption spectrum, but the present disclosure is not limited thereto. The signal processing unit (123) may measure the average space temperature on an optical axis based on two line thermometry as shown in Non Patent Literature 5.

In the first example embodiment, the determiner (127) determine whether there is a fire using the difference between measured values of the gas concentrations, the smoke concentrations, and the temperatures, but the present disclosure is not limited thereto. The determiner (127) may determine whether there is a fire based on an amount of change in the difference between the measured values per unit time. The determiner (127) determines that a fire has occurred when the amount of change in the difference between the measured values per unit time is greater than a threshold.

In the first example embodiment, the determiner (127) determines whether there is a fire by referring to all the measured values of the gas concentration, the smoke concentration, and the temperature, but the present disclosure is not limited thereto. The determiner (127) may determine whether there is a fire by referring to one or two of the gas concentration, the smoke concentration, and the temperature.

Second Example Embodiment

A second example embodiment of the present disclosure will be described with reference to FIGS. 3 and 4. In the first example embodiment, the transmitter (11) and the receiver (12) are placed at spatially separated positions, and the first gas concentration, the first smoke concentration, and the first temperature in the space of the light propagation section are measured. On the other hand, in the second example embodiment, the optical signal from a transceiver (42) is returned at a first reflection unit (41), and the first gas concentration, the first smoke concentration, and the first temperature in the light propagation section are measured.

Configuration of the Second Example Embodiment

Figure 4:
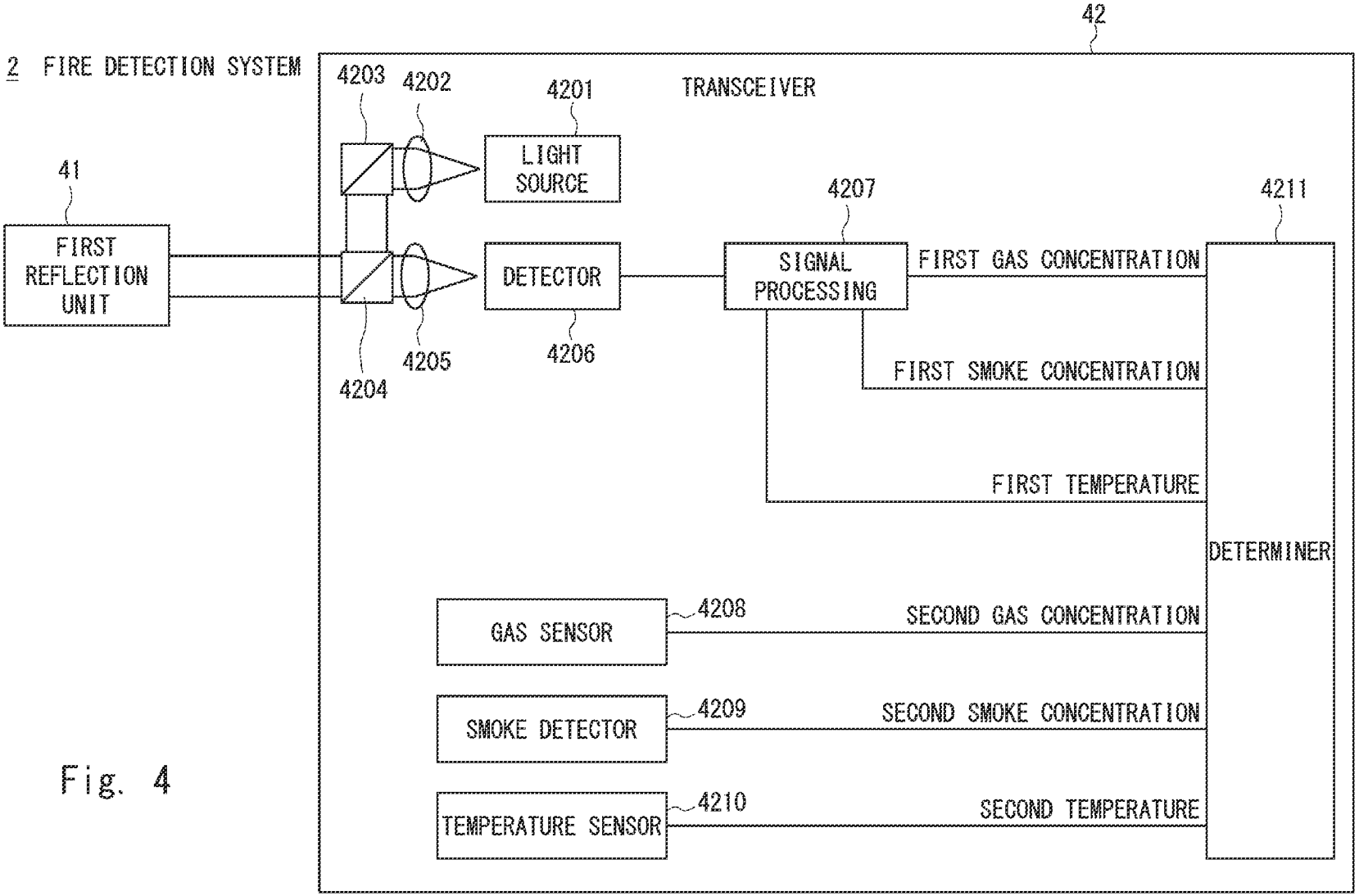
FIG. 4 is a block diagram showing a configuration of a fire detection system according to a second example embodiment of the present disclosure.

FIG. 4 is a block diagram showing the configuration of the second example embodiment. A fire detection system (2) according to the second example embodiment of the present disclosure includes the first reflection unit (41) and the transceiver (42). The transceiver (42) includes the transmitter (11) and the receiver (12) described above, which are accommodated in one housing and are integrated. The first reflection unit (42) is disposed at a predetermined distance from the transceiver (41). A predetermined light propagation section is formed between the transceiver (42) and the first reflection unit (41). The optical signal transmitted from the transceiver (42) reciprocates between the transceiver (42) and the first reflection unit (41). The fire detection system (2) propagates the optical signal between the transceiver (42) and the first reflection unit (41), and measures the first gas concentration, the first smoke concentration, and the first temperature in the space of the light propagation section. The transceiver (42) includes a light source (4201), condensers (4202, 4205), multiplexers/demultiplexers (4203, 4204), a detector (4206), a signal processing unit (4207), a gas sensor (4208), a smoke detector (4209), a temperature sensor (4210), and a determiner (4211).

Operation of the Second Example Embodiment

The light source (4201) outputs the optical signal having a wavelength $\lambda_1$ μm. The condenser (4202) converts the optical signal from the light source (4201) into a quasi-parallel beam. The multiplexers/demultiplexers (4203, 4204) emit the quasi-parallel beam from the condenser (4202) into space. The optical signal emitted from the transceiver (42) is reflected by the first reflection unit (41) and returned to the transceiver (42). Here, the first reflection unit (41) is a retroreflector. The first reflection unit (41) reflects the optical signal in a direction parallel to the propagation direction of the optical signal propagated from the transceiver (42). Thus, the optical signal accurately returns to the transceiver (42).

The returned optical signal passes through the multiplexer/demultiplexer (4204), condensed by the condenser (4205), and photoelectrically converted by the detector (4206). The signal processing unit (4207) processes the electric signal photoelectrically converted by the detector (4206) to thereby calculate the first gas (CO) concentration, the first smoke concentration, and the first temperature between the transceiver (42) and the first reflection unit (41). Since the method of calculating the measured values is the same as the method of calculating the measured value described in the first example embodiment, a detailed description thereof is omitted.

The gas sensor (4208) measures the second gas concentration around the transceiver (42). The smoke detector (4209) measures the second smoke concentration around the transceiver (42). The temperature sensor (4210) measures the second temperature around the transceiver (42).

The determiner (4211) determines a fire state using the above measurement results of the first and second gas concentrations, the first and second smoke concentrations, and the first and second temperatures as parameters based on the flowchart shown in FIG. 3.

Effect of the Second Example Embodiment

According to the second example embodiment, the following effects can be achieved.

A first effect is that, in a manner similar to the first example embodiment, a fire can be accurately detected when a environmental change occurs while, for example, vehicles travel under a condition where there can be a large environmental change such as in a road tunnel. A reason for this is that, in the related art, a determination of whether there is a fire is made based only on the gas concentration and smoke concentration in the long distance light propagation section.

For this reason, when the environmental change is large, erroneous determination is often caused. On the other hand, in the second example embodiment, as described above, the local second gas concentration, the local second smoke concentration, and the local second temperature around the transceiver (42) are incorporated into the flow of determining whether there is a fire as environmental reference values, so that the influence of the environmental change can be canceled.

A second effect is that the work at the time of the sensor installation can be facilitated. A reason for this is that, in Patent Literature 1 and the first example embodiment, the transmitter (11) and the receiver (12), which require power supplies, are separated at two places, and thus power supply installation work is required at each place. On the other hand, the configuration according to the second example embodiment is such that the parts requiring the power supply are integrated into one transceiver (42), and another part not requiring the power supply is a passive component, i.e., the first reflection unit 41, so that the power supply installation work is required in only one place.

The second example embodiment is not limited to the above configuration. For example, in the second example embodiment, the light source (4201) is configured as a laser light source and instead the light source (4201) may be configured as a broadband light source such as an LED (Light Emitting Diode) or an SLD (Super Luminescent Diode). The signal processing unit (4207) may measure the gas concentration by DOAS accordingly.

In the second example embodiment, as shown in FIG. 4, a driver for driving the light source (4201) is not explicitly specified, but it is assumed that the laser wavelength and intensity are appropriately controlled.

An optical amplifier may be inserted into an output stage of the light source (4201) or an input stage of the detector (4206). By doing so, the signal-to-noise ratio of the received optical signal can be improved, and the accuracy of the measurement result can be improved.

The determiner (4211) uses the CO concentration as an indicator for determining a fire state but the indicator of determining the fire state is not limited to this. The determiner (4211) may use, as the indicator for determining the fire state, a carbon dioxide ($CO_2$) concentration, a water vapor ($H_2O$) concentration, or a ratio of the CO concentration to the $CO_2$ concentration as described in Non Patent Literature 4, etc. The output wavelength $\lambda_1$ of the light source (4201) may be set as the absorption wavelength of $CO_2$ or $H_2O$ accordingly. A plurality of kinds of gas concentrations may be measured using a plurality of light sources.

In the second example embodiment, CO is selected as the gas species to be measured, and 10 [ppm] is set as a gas concentration threshold, but the present disclosure is not limited thereto. Another value may be set as the threshold, or the determination may be made using another gas concentration. Further, although 0.4 [l/m] is set as the smoke concentration threshold, another value may be set as this threshold.

In the second example embodiment, the signal processing unit (4207) measures the average space temperature in the predetermined light propagation section based on the spread of the spectral width of the absorption spectrum, but the present disclosure is not limited thereto. The signal processing unit (4207) may measure the average space temperature on an optical axis based on two line thermometry as shown in Non Patent Literature 5.

In the second example embodiment, the determiner (4211) determines whether there is a fire using the difference between measured values of the gas concentrations, the smoke concentrations, and the temperatures, but the present disclosure is not limited thereto. The determiner (4211) may determine whether there is a fire based on an amount of change in the difference between the measured values per unit time.

In the second example embodiment, the first reflection unit (41) is configured as a retroreflective reflector to reflect spatially propagated optical signals, but the present disclosure is not limited thereto. The first reflection unit (41) may be configured as a simple plane mirror.

In the second example embodiment, the determiner (4211) determines whether there is a fire by referring to all the measured values of the gas concentration, the smoke concentration, and the temperature, but the present disclosure is not limited thereto. The determiner (4211) may determine whether there is a fire by referring to one or two of the gas concentration, the smoke concentration, and the temperature.

Third Example Embodiment

A third example embodiment of the present disclosure will be described with reference to FIGS. 3, 5, and 6. The fire detection systems (1) and (2) according to the first and second example embodiments use individual point sensors to measure the local second gas concentration, the local second smoke concentration, and the local second temperature around the receiver (12) and the transceiver (42). On the other hand, a fire detection system (3) according to the third example embodiment measures the local second gas concentration, the local second smoke concentration, and the local second temperature using an optical signal.

Configuration of the Third Example Embodiment

Figure 5:
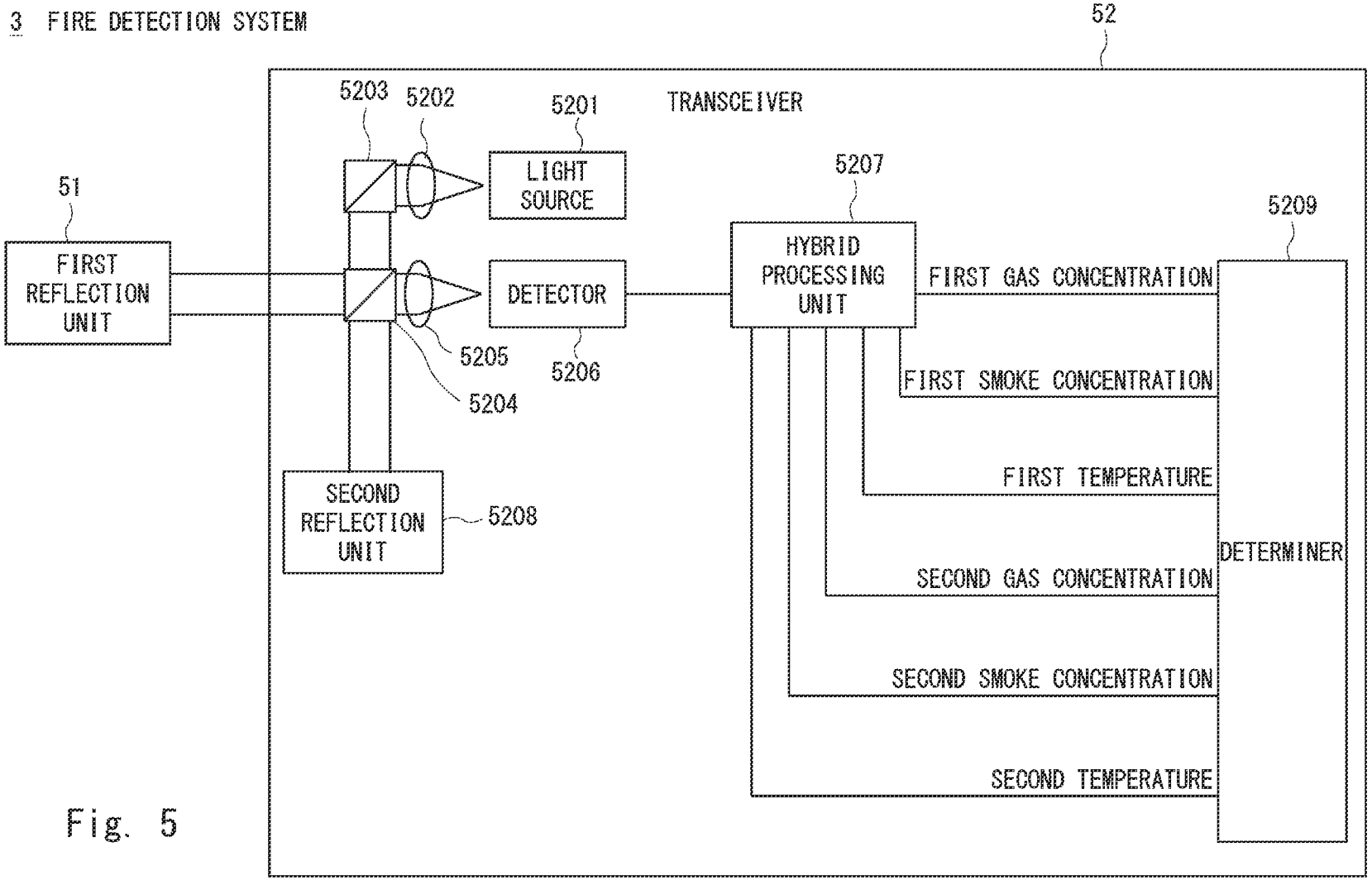
FIG. 5 is a block diagram showing a configuration of a fire detection system according to a third example embodiment of the present disclosure.
Figure 6:
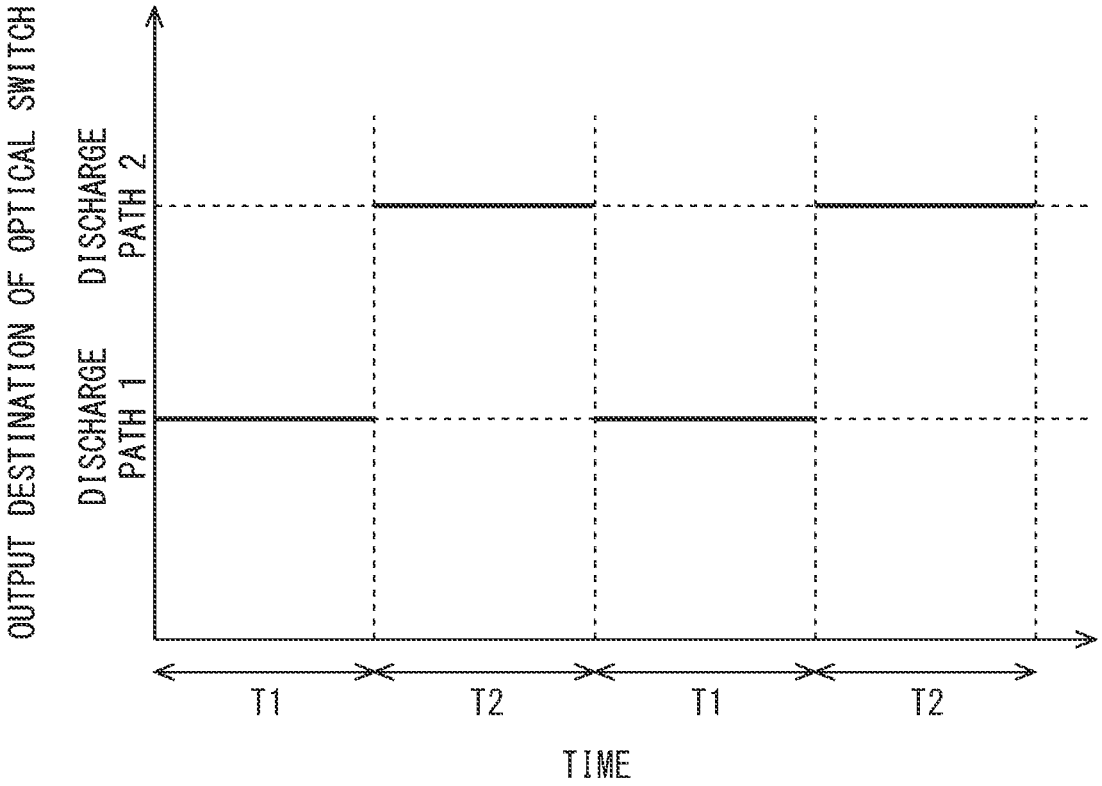
FIG. 6 is an explanatory diagram showing control of optical components according to the third example embodiment of the present disclosure.
Figure 7:
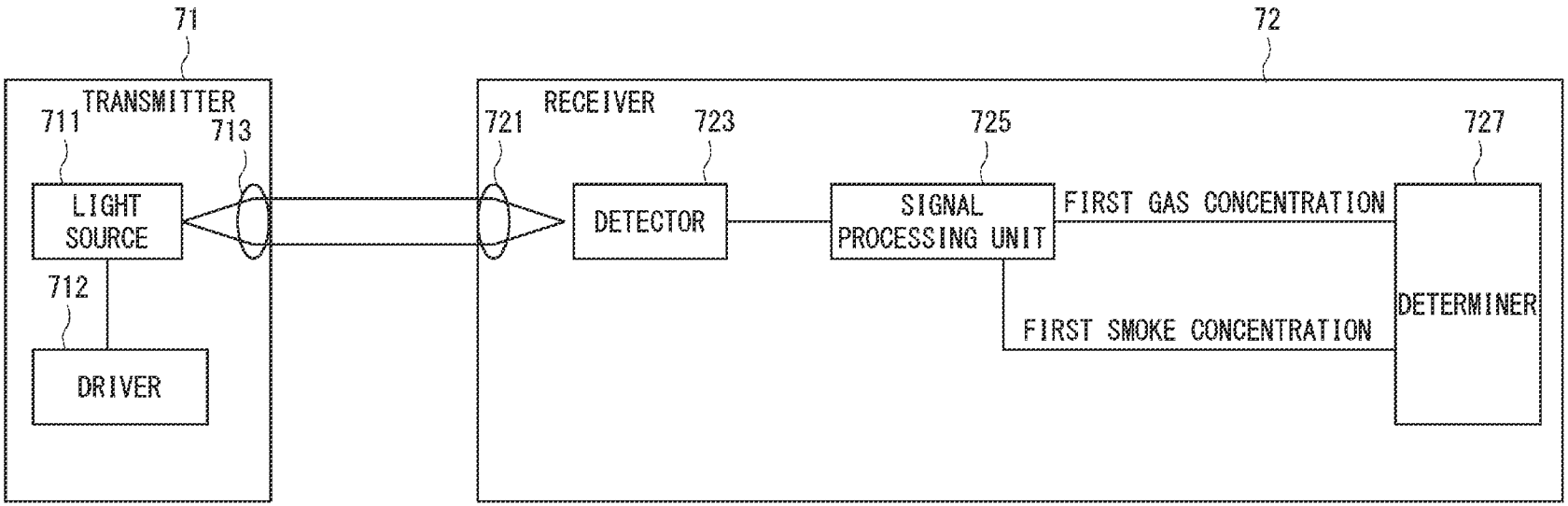
FIG. 7 is a block diagram showing a configuration of a fire detection system according to related art.

FIG. 5 is a block diagram showing the configuration of the third example embodiment. The fire detection system (3) according to the third example embodiment of the present disclosure includes a first reflection unit (51) and a transceiver (52). The fire detection system (3) transmits the optical signal between the transceiver (52) and the first reflection unit (51), and measures the first gas concentration, the first smoke concentration and the first temperature in a space between the transceiver (52) and the first reflection unit (51). The transceiver (52) includes a light source (5201), condensers (5202, 5205), multiplexer/demultiplexer (5203), an optical switch (5204), a detector (5206), a hybrid processing unit (5207), a second reflection unit (5208), and a determiner (5209).

Operation of the Third Example Embodiment

The light source (5201) outputs the optical signal having a wavelength $\lambda_1$ μm. The condenser (5202) converts the optical signal from the light source (5201) into a quasi-parallel beam. The quasi-parallel beam passes through the multiplexer/demultiplexer (5203) and enters the optical switch (5204). As shown in FIG. 6, the optical switch (5204) emits the optical signal to discharge paths 1 or 2 depending on the time.

During a time T1, the optical switch (5204) emits the optical signal input from the multiplexer/demultiplexer (5203) in a direction (hereinafter referred to as the discharge path 1) of the first reflection unit (51), and outputs the optical signal input from the discharge path 1 in a direction of the condenser (5205). The optical signal emitted from the transceiver (52) is reflected by the first reflection unit (51) and returned to the transceiver (52). Here, the first reflection unit (51) is a retroreflector. The first reflection unit (51) reflects the optical signal in a direction parallel to the propagation direction of the optical signal propagated from the transceiver (52). Thus, the optical signal accurately returns to the transceiver (52). The returned optical signal passes through the optical switch (5204), condensed by the condenser (5205), and photoelectrically converted by the detector (5206). The hybrid processing unit (5207) performs predetermined processing on the electric signal photoelectrically converted by the detector 5206 to thereby calculate the first gas (CO) concentration, the first smoke concentration, and the first temperature between the transceiver (52) and the first reflection unit (51). Since the method of calculating the measured values is the same as the method of calculating the measured value described in the first example embodiment, a detailed description thereof is omitted.

During a time T2, the optical switch (5204) emits the optical signal input from the multiplexer/demultiplexer (5203) in a direction (hereinafter referred to as the discharge path 2) of the second reflection unit (5205), and outputs the optical signal input from the discharge path 2 in a direction of the condenser (5208). The optical signal emitted from the optical switch (5204) is reflected by the second reflection unit (5208) and returned to the optical switch (5204). Here, the second reflection unit (5208) is a retroreflector. The second reflection unit (5208) reflects the optical signal in a direction parallel to the propagation direction of the optical signal propagated from the optical switch (5204). Thus, the optical signal accurately returns to the optical switch (5204). The returned optical signal passes through the optical switch (5204), condensed by the condenser (5205), and photoelectrically converted by the detector (5206). The hybrid processing unit (5207) performs predetermined processing on the electric signal photoelectrically converted by the detector 5206 to thereby calculate the second gas (CO) concentration, the second smoke concentration, and the second temperature around the transceiver (52). Since the method of calculating the measured values is the same as the method of calculating the measured value described in the first example embodiment, a detailed description thereof is omitted.

The determiner (5209) determines a fire state using the above measurement results of the first and second gas concentrations, the first and second smoke concentrations, and the first and second temperatures as parameters based on the flowchart shown in FIG. 3.

Effect of the Third Example Embodiment

According to the third example embodiment, the following effects can be achieved.

A first effect is that, in a manner similar to the first and second example embodiments, a fire can be accurately detected when a environmental change occurs while, for example, vehicles travel under a condition where there can be a large environmental change such as in a road tunnel. A reason for this is that, in the related art, a determination of whether there is a fire is made based only on the gas concentration and smoke concentration in the long distance light propagation section. For this reason, when the environmental change is large, erroneous determination is often caused. On the other hand, in the third example embodiment, as described above, the local second gas concentration, the local second smoke concentration, and the local second temperature around the transceiver (52) are incorporated into the flow of determining whether there is a fire as environmental reference values, so that the influence of the environmental change can be canceled.

A second effect is that, in a manner similar to the second example embodiment, the work at the time of the sensor installation can be facilitated. A reason for this is that, in Patent Literature 1 and the first example embodiment, the transmitter (11) and the receiver (12), which require power supplies, are separated at two places, and thus power supply installation work is required at each place.

On the other hand, the configuration according to the third example embodiment is such that the parts requiring the power supply are integrated into one transceiver (52), and another part not requiring the power supply is a passive component, i.e., the first reflection unit (51), so that the power supply installation work is required in only one place.

A third effect is that the sensor configuration can be simplified and the number of parts can be reduced. A reason for this is that, in the first and second example embodiments, the gas sensor, the smoke detector, and the temperature sensor are used to acquire local environmental information, so that the number of parts is increased. On the other hand, in the third example embodiment, peripheral environmental information is acquired by utilizing the optical signal for measuring the long distance section. For this reason, the sensor configuration can be simplified and the number of parts can be reduced.

The third example embodiment is not limited to the above configuration. For example, in the third example embodiment, the light source (5201) uses a laser light source and instead a broadband light source such as an LED (Light Emitting Diode) or an SLD (Super Luminescent Diode) may be used. The hybrid processing unit (5207) may measure the gas concentration by DOAS accordingly.

In the third example embodiment, as shown in FIG. 5, a driver for driving the light source (5201) is not explicitly specified, but it is assumed that the laser wavelength and intensity are appropriately controlled.

An optical amplifier may be inserted into an output stage of the light source (5201) or an input stage of the detector (5206). By doing so, the signal-to-noise ratio of the received optical signal can be improved, and the accuracy of the measurement result can be improved.

The determiner (5209) uses the CO concentration as an indicator for determining a fire state but the indicator of determining the fire state is not limited to this. The determiner (5209) may use, as the indicator for determining the fire state, a carbon dioxide ($CO_2$) concentration or a water vapor ($H_2O$) concentration. The determiner (5209) may use, the indicator for determining the fire state, a ratio of the CO concentration to the $CO_2$ concentration as described in Non Patent Literature 4, etc. The output wavelength $\lambda_1$ of the light source (5201) may be set as the absorption wavelength of $CO_2$ or $H_2O$ accordingly. A plurality of kinds of gas concentrations may be measured using a plurality of light sources.

In the third example embodiment, CO is selected as the gas species to be measured, and 10 [ppm] is set as a gas concentration threshold, but the present disclosure is not limited thereto. Another value may be set as the threshold, or the determination may be made using another gas concentration. Further, although 0.4 [l/m] is set as a smoke concentration threshold, another value may be set as this threshold.

In the third example embodiment, the hybrid processing unit (5207) measures the average space temperature in the light propagation section based on the spread of the spectral width of the absorption spectrum, but the present disclosure is not limited thereto. The hybrid processing unit (5207) may measure the average space temperature on an optical axis based on two line thermometry as shown in Non Patent Literature 5.

In the third example embodiment, the determiner (5209) determines whether there is a fire using the difference between measured values of the gas concentrations, the smoke concentrations, and the temperatures, but the present disclosure is not limited thereto. The determiner (5209) may determine whether there is a fire based on an amount of change in the difference between the measured values per unit time.

In the third example embodiment, the first reflection unit (51) is configured as a retroreflective reflector to reflect spatially propagated optical signals, but the present disclosure is not limited thereto. The first reflection unit (51) may be configured as a simple plane mirror.

In the third example embodiment, the determiner (5209) determines whether there is a fire by referring to all the measured values of the gas concentration, the smoke concentration, and the temperature, but the present disclosure is not limited thereto. The determiner (5209) may determine whether there is a fire by referring to one or two of the gas concentration, the smoke concentration, and the temperature.

Although the present disclosure has been described with reference to the above example embodiments, the present disclosure is not limited by the above. Various changes that can be understood by a person skilled in the art within the scope of the disclosure may be made to the configurations and details of the present disclosure.

The present disclosure can also be realized by causing the CPU to execute the processing shown in FIG. 3 by a computer program.

The program can be stored and provided to a computer using any type of non-transitory computer readable media. Non-transitory computer readable media include any type of tangible storage media. Examples of non-transitory computer readable media include magnetic storage media (such as floppy disks, magnetic tapes, hard disk drives, etc.), optical magnetic storage media (e.g. magneto-optical disks), CD-ROM (Read Only Memory), CD-R, CD-R/W, and semiconductor memories (such as mask ROM, PROM (Programmable ROM), EPROM (Erasable PROM), flash ROM, RAM (random access memory), etc.).

The program may be provided to a computer using any type of transitory computer readable media. Examples of transitory computer readable media include electric signals, optical signals, and electromagnetic waves. Transitory computer readable media can provide the program to a computer via a wired communication line (e.g. electric wires, and optical fibers) or a wireless communication line.

INDUSTRIAL APPLICABILITY

The present disclosure is applicable to fire detection in a wide space. In particular, the present disclosure is applicable to fire detection in a situation where various ignition sources such as a road tunnel are present and various gases such as exhaust gas are present.

REFERENCE SIGNS LIST

1, 2, 3 FIRE DETECTION SYSTEM
11, 71 TRANSMITTER
12, 72 RECEIVER
111, 4201, 5201, 711 LIGHT SOURCE
112, 712 DRIVER
115, 121, 4202, 4205, 5202, 5205, 713, 721 CONDENSER
122, 4206, 5206, 723 DETECTOR
123, 4207, 725 SIGNAL PROCESSING UNIT
5207 HYBRID PROCESSING UNIT
124, 4208 GAS SENSOR
125, 4209 SMOKE DETECTOR
126, 4210 TEMPERATURE SENSOR
127, 4211, 5209, 727 DETERMINER
41, 51 FIRST REFLECTION UNIT
5208 SECOND REFLECTION UNIT
42, 52 TRANSCEIVER

4203, 4204, 5203 MULTIPLEXER/DEMULTIPLEXER
5204 OPTICAL SWITCH

What is claimed is:

1. A fire detection system comprising:

a transmitter including a light source configured to send an optical signal; and a receiver comprising:

a detector configured to detect the optical signal sent from the light source through a predetermined light propagation section;

a signal processing unit configured to calculate at least one of a first gas concentration, a first smoke concentration, and a first temperature in the light propagation section based on the optical signal detected by the detector;

a sensor configured to acquire at least one of a second gas concentration, a second smoke concentration, and a second temperature in the surroundings; and a determiner configured to determine whether or not there is a fire by comparing at least one of the first gas concentration, the first smoke concentration, and the first temperature calculated by the signal processing unit with at least one of the second gas concentration, the second smoke concentration, and the second temperature in the surroundings acquired by the sensor, wherein the transmitter and the receiver are integrated as a transceiver, a first reflection unit disposed at a predetermined distance from the transceiver, wherein the predetermined light propagation section is formed between the transceiver and the first reflection unit, and the optical signal sent from the light source of the transceiver reciprocates in the predetermined light propagation section between the transceiver and the first reflection unit.

2. The fire detection system according to claim 1, wherein the sensor includes at least one of a gas sensor configured to measure the second gas concentration around the receiver, a smoke detector configured to measure the second smoke concentration around the receiver, and a temperature sensor configured to measure the second temperature around the receiver.

3. The fire detection system according to claim 1, wherein the signal processing unit and the sensor are integrated as a hybrid processing unit, and the transceiver further includes a second reflection unit configured to reflect the optical signal sent from the light source and an optical switch configured to switch between a direction of the first reflection unit and a direction of the second reflection unit and then emit the optical signal sent from the light source, and the hybrid processing unit is configured to calculate at least one of the first gas concentration, the first smoke concentration, and the first temperature in the light propagation section based on the optical signal reflected from the first reflection unit and detected by the detector, and at least one of the second gas concentration, the second smoke concentration, and the second temperature in the surroundings based on the optical signal reflected from the second reflection unit and detected by the detector.

4. The fire detection system according to claim 1, wherein the determiner is configured to calculate a difference between at least one of the first gas concentration, the first smoke concentration, and the first temperature in the predetermined light propagation section of the optical signal calculated by the signal processing unit and at least one of the second gas concentration, the second smoke concentration, and the second temperature in the surroundings acquired by the sensor, respectively, and determine that the fire has occurred when each difference is greater than a threshold.

5. The fire detection system according to claim 4, wherein the determiner is configured to calculate an amount of change in the difference per unit time and determine that the fire has occurred when the calculated amount of change is greater than a threshold.

6. A fire detection method comprising:

sending an optical signal from a light source by a transmitter;

detecting the optical signal sent from the light source through a predetermined light propagation section by a receiver;

calculating at least one of a first gas concentration, a first smoke concentration, and a first temperature in the light propagation section based on the detected optical signal by the receiver;

acquiring at least one of a second gas concentration, a second smoke concentration, and a second temperature in the surroundings by the receiver; and determining whether or not there is a fire by comparing at least one of the calculated first gas concentration, the calculated first smoke concentration, and the calculated first temperature with at least one of the acquired second gas concentration, the acquired second smoke concentration, and the acquired second temperature in the surroundings by the receiver, wherein the transmitter and the receiver are integrated as a transceiver, wherein a first reflection unit is disposed at a predetermined distance from the transceiver, wherein the predetermined light propagation section is formed between the transceiver and the first reflection unit, and wherein the optical signal sent from the light source of the transceiver reciprocates in the predetermined light propagation section between the transceiver and the first reflection unit.

* * * * *